US010226936B2

(12) United States Patent
Yamamoto

(10) Patent No.: US 10,226,936 B2
(45) Date of Patent: Mar. 12, 2019

(54) LIQUID JETTING APPARATUS

(71) Applicant: BROTHER KOGYO KABUSHIKI KAISHA, Nagoya-shi, Aichi-ken (JP)

(72) Inventor: Hideki Yamamoto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/711,802

(22) Filed: Sep. 21, 2017

(65) Prior Publication Data

US 2018/0093512 A1 Apr. 5, 2018

(30) Foreign Application Priority Data

Sep. 30, 2016 (JP) ..... 2016-193708

(51) Int. Cl.
*B41J 2/175* (2006.01)
*B41J 29/13* (2006.01)
*G03G 21/16* (2006.01)

(52) U.S. Cl.
CPC ..... *B41J 2/17553* (2013.01); *B41J 2/1752* (2013.01); *B41J 2/17503* (2013.01); *B41J 2/17509* (2013.01); *B41J 29/13* (2013.01); *G03G 21/1633* (2013.01); *G03G 2221/169* (2013.01)

(58) Field of Classification Search
CPC .. B41J 2/17553; B41J 2/17503; B41J 2/1752; B41J 2/17509; G03G 21/1633; G03G 2221/169
See application file for complete search history.

(56) References Cited

U.S. PATENT DOCUMENTS

2007/0120901 A1* 5/2007 Sugiyama ..... B41J 2/1752 347/85
2013/0063532 A1 3/2013 Takata et al.

FOREIGN PATENT DOCUMENTS

JP 11-330725 A 11/1999
JP 2012-51328 A 3/2012
JP 2013-56508 A 3/2013

* cited by examiner

*Primary Examiner* — Geoffrey S Mruk
(74) *Attorney, Agent, or Firm* — Merchant & Gould P.C.

(57) ABSTRACT

A liquid jetting apparatus includes: a liquid jetting unit which jets liquid; a casing including a tank storing part in which a tank containing the liquid to be supplied to the liquid jetting unit is stored, and having an opening which allows the tank storing part to communicate with an outside of the casing; and a cover pivotally attached to the casing and selectively positioned in a closed position where the opening is closed and an opened position where the opening is open. The casing includes an engaging part which engages with the cover in the closed position to prevent the pivoting of the cover. The liquid jetting apparatus further includes a movement mechanism which moves the cover relative to the casing between an engagement position where the engaging part is engaged with the cover and a release position where the pivoting of the cover is not prevented.

12 Claims, 5 Drawing Sheets

LIQUID JETTING APPARATUS

CROSS REFERENCE TO RELATED APPLICATION

The present application claims priority from Japanese Patent Application No. 2016-193708 filed on Sep. 30, 2016, the disclosure of which is incorporated herein by reference in its entirety.

BACKGROUND

Field of the Invention

The present invention relates to a liquid jetting apparatus including a liquid jetting unit and a casing provided with a tank storing part in which a tank containing liquid to be supplied to the liquid jetting unit is stored.

Description of the Related Art

There is conventionally known a recording apparatus having a casing in which a cartridge installing part (tank storing part) is formed. The casing has an opening that allows the cartridge installing part to communicate with the outside of the casing. The casing is provided with a cover pivotally attached thereto and selectively positioned in a closed position where the opening is closed and in an opened position where the opening is open. The cover is kept in the closed position by engaging a claw formed in an end surface of the cover with an engaging part formed in an edge of the opening of the casing.

SUMMARY

When foreign matter, such as dust, enters the tank storing part from the outside of the casing through the opening, the foreign matter may adhere to a liquid inlet of a tank and/or enter a liquid channel leading from the tank to a liquid jetting unit. This may cause a failure in liquid jetting of the liquid jetting unit. Further, the liquid may leak from the tank storing part to the outside of the casing through the opening. The above recording apparatus has solved these problems by engaging the claw of the cover in the closed position with the engaging part of the casing. In that configuration, however, engagement between the claw of the cover and the engaging part of the casing may make the pivoting of the cover difficult.

An object of the present teaching is to provide a liquid jetting apparatus that can prevent the entrance of foreign matter and liquid leakage through an opening and facilitate pivoting of a cover.

According to an aspect of the present teaching, there is provided a liquid jetting apparatus, including: a liquid jetting unit configured to jet liquid; a casing including a tank storing part in which a tank containing the liquid to be supplied to the liquid jetting unit is stored, and having an opening which allows the tank storing part to communicate with an outside of the casing; and a cover pivotally attached to the casing and selectively positioned in a closed position where the opening is closed and an opened position where the opening is open, wherein the casing includes an engaging part configured to engage with the cover in the closed position to prevent the pivoting of the cover, and the liquid jetting apparatus further includes a movement mechanism configured to move the cover relative to the casing between an engagement position where the engaging part is engaged with the cover to prevent the pivoting of the cover and a release position where the pivoting of the cover is not prevented.

According to the aspect of the present teaching, engaging the engaging part with the cover in the closed position can prevent the entrance of foreign matter and liquid leakage through the opening. Further, allowing the movement mechanism to move the cover from the engagement position to the release position facilitates the pivoting of the cover.

DESCRIPTION OF THE EMBODIMENTS

[First Embodiment]

Figure 1:
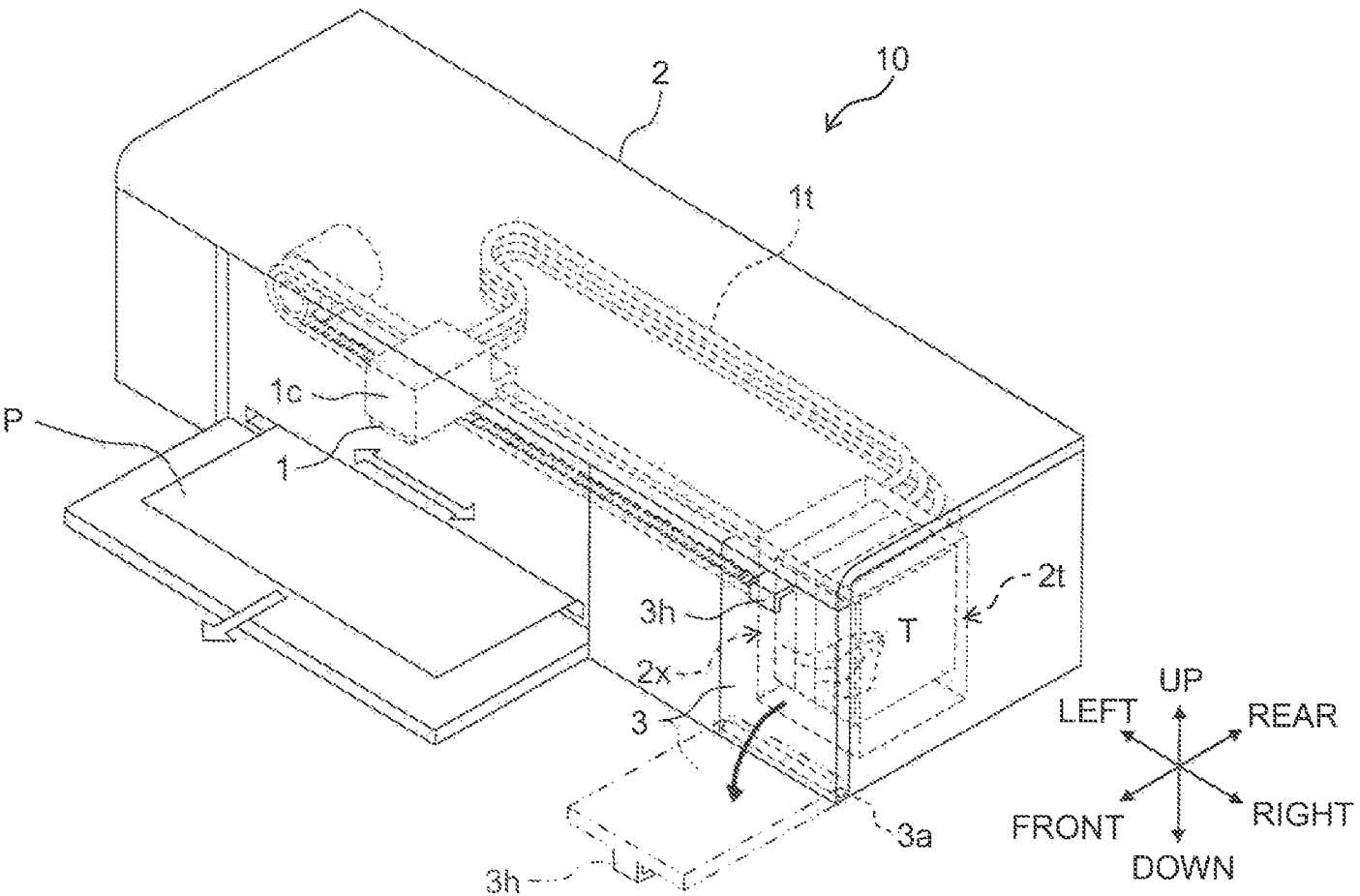
FIG. 1 is a perspective view of a printer according to a first embodiment of the present teaching.

Referring to FIG. 1, an overall configuration of a printer 10 according to the first embodiment of the present teaching will be explained.

The printer 10 includes a head 1 and a casing 2.

The head 1 includes jetting ports (not depicted) through which inks are jetted. Any one of cyan, magenta, yellow, and black inks is jetted from each jetting port. The head 1 held by a carriage 1*c* jets each ink from each jetting port while reciprocating in a left-right direction, thus forming an image on a sheet P that is conveyed from a rear side to a front side by a conveyance mechanism (not depicted).

The casing 2 includes a tank storing part 2*t* that stores four cartridge-type tanks T. Each of the tanks T contains the corresponding one of the four inks to be supplied to the head 1. The tanks T stored in the tank storing part 2*t* communicate with the head 1 via tubes 1*t*. A front side surface of the casing 2 is formed with an opening 2*x* that allows the tank storing part 2*t* to communicate with the outside of the casing 2.

A cover 3 is attached to a part of the casing 2 formed with the opening 2*x*. The cover 3 is pivotally attached to the casing 2 with a pivoting shaft 3*a* as a pivoting center. The cover 3 may selectively be positioned in a closed position (a position depicted by a solid line in FIG. 1) in which the opening 2*x* is closed with the cover 3 and in an opened position (a position depicted by a broken line in FIG. 1) in which the opening 2*x* is open. The pivoting shaft 3*a*, which is disposed below the opening 2*x*, extends in the left-right direction. A handle 3*h* is provided in an upper portion of an outer surface of the cover 3. A user may open and close the cover 3 by holding the handle 3*h*.

Referring to FIG. 2 to FIG. 4B, configurations of the casing 2 and the cover 3 will be explained in detail.

Figure 2:
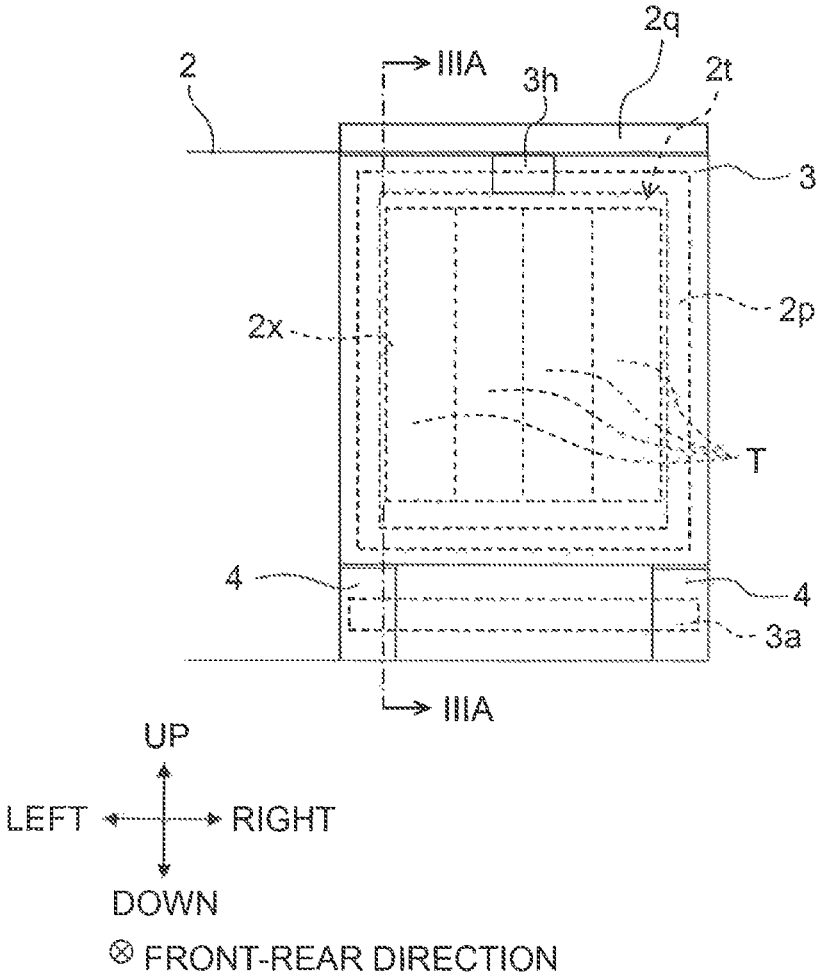
FIG. 2 is a side view of a part, of a casing of the printer, provided with a cover.

A protrusion 2*p* is formed in front end surfaces of walls defining the opening 2*x* of the casing 2. The walls include an upper wall 2*w*1, a lower wall 2*w*2, and left and right walls. The upper wall 2*w*1 defines an upper edge of the opening 2*x*, the lower wall 2*w*2 defines a lower edge of the opening 2*x*, and left and right walls define left and right edges of the opening 2*x*. As depicted in FIG. 2, the protrusion 2*p* surrounds the whole circumference of the opening 2*x*.

An eaves member 2*q* is provided in the vicinity of an upper portion of the opening 2*x* of the casing 2 to cover an upper edge of the cover 3 in the closed position. The eaves member 2*q* continues from an upper portion of the front end surface of the upper wall 2*w*1 and extends along the upper edge of the opening 2*x*. The length of the eaves 2*q* in the left-right direction is the same as the length of the cover 3 in the left-right direction (see FIG. 2). As depicted in FIG. 3A to FIG. 4B, the eaves member 2*q* includes a horizontal part 2*q*1 extending frontward from the front end surface of the upper wall 2*w*1 and a vertical part 2*q*2 extending upward from a front end of the horizontal part 2*q*1. The horizontal part 2*q*1 is disposed above the protrusion 2*p* of the upper wall 2*w*1 to face the protrusion 2*p*. The horizontal part 2*q*1 extends frontward beyond the protrusion 2*p*. In the front-rear direction, a front surface of the vertical part 2*q*2 is at substantially the same position as a front surface of the cover 3 in the closed position.

Figure 3A:
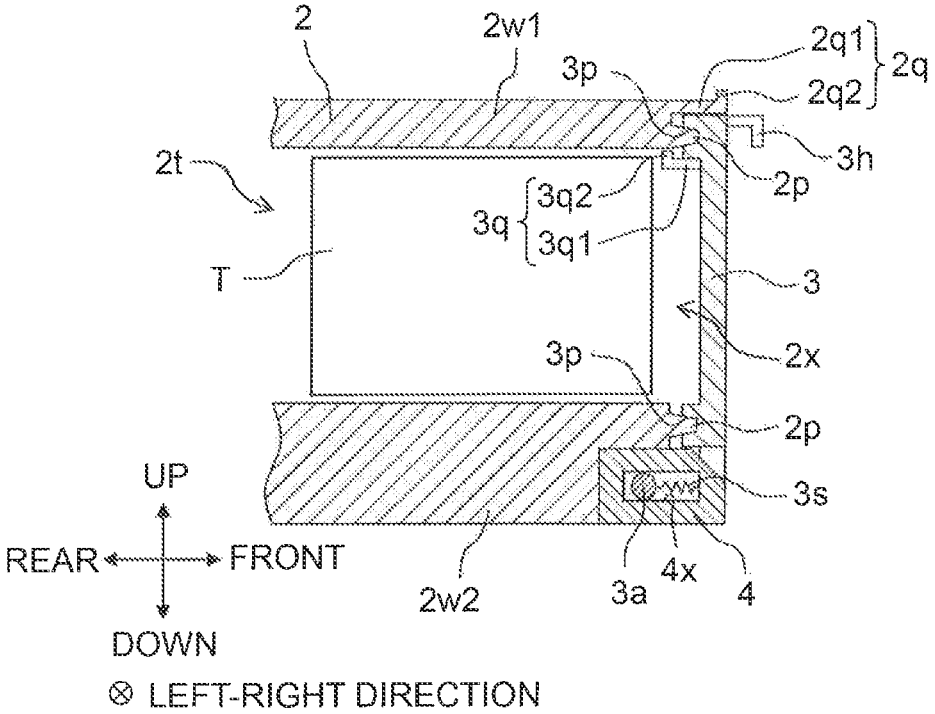
FIG. 3A is a cross-sectional view taken along a line IIIA-IIIA of FIG. 2.

An inner surface of the cover 3 is formed with a recess 3*p* having a shape corresponding to the protrusion 2*p* of the casing 2 and into which the protrusion 2*p* is to be fitted. As depicted in FIG. 3A, when the cover 3 is in the closed position, the protrusion 2*p* is fitted into the recess 3*p*. This keeps the cover 3 in the closed position and prevents pivoting of the cover 3. Namely, the casing 2 includes the protrusion 2*p* as an engaging part that engages with the cover 3 in the closed position to prevent the pivoting of the cover 3. When the protrusion 2*p* is fitted into the recess 3*p* with the cover 3 in the closed position, the opening 2*x* is airtightly covered with the cover 3 to seal the tank storing part 2*t* in the casing 2.

A protrusion 3*q* is provided in the inner surface of the cover 3. As depicted in FIG. 3A, when the cover 3 is in the closed position, the protrusion 3*q* is disposed below the upper wall 2*w*1 (particularly, the protrusion 2*p* of the upper wall 2*w*1) to face the protrusion 2*p*. The protrusion 3*q* extends parallel to the upper edge of the cover 3, is disposed below an upper portion of the recess 3*p* which is parallel to the upper edge of the cover 3, and is positioned between left and right portions of the recess 3*p* that extend along left and right edges of the cover 3, respectively. The protrusion 3*q* includes a horizontal part 3*q*1 that extends rearward from the inner surface of the cover 3 with the cover 3 in the closed position and a vertical part 3*q*2 that extends upward from a rear end of the horizontal part 3*q*1.

As depicted in FIG. 2, guide members 4 are respectively provided at left and right ends of a front end of the lower wall 2*w*2 of the casing 2. The guide members 4 support left and right ends of the pivoting shaft 3*a*, respectively. As depicted in FIG. 3A to FIG. 4B, each guide member 4 includes a rectangular cavity 4*x* that is long in the front-rear direction. The pivoting shaft 3*a* is movable in the front-rear direction (a direction orthogonal to the surface of the casing 2 formed with the opening 2*x*) with the left and right ends of the pivoting shaft 3*a* being inserted into the cavities 4*x* of the guide members 4.

A spring 3*s* that urges the pivoting shaft 3*a* rearward is provided in each cavity 4*x*. The spring 3*s* has a first end attached to the pivoting shaft 3*a* and a second end attached to a front wall defining the cavity 4*x* of each guide member 4. The spring 3*s* urges the cover 3 in the opened position toward the closed position.

Subsequently, referring to FIG. 3A to FIG. 4B, the opening and closing operations of the cover 3 will be explained.

Figure 3B:
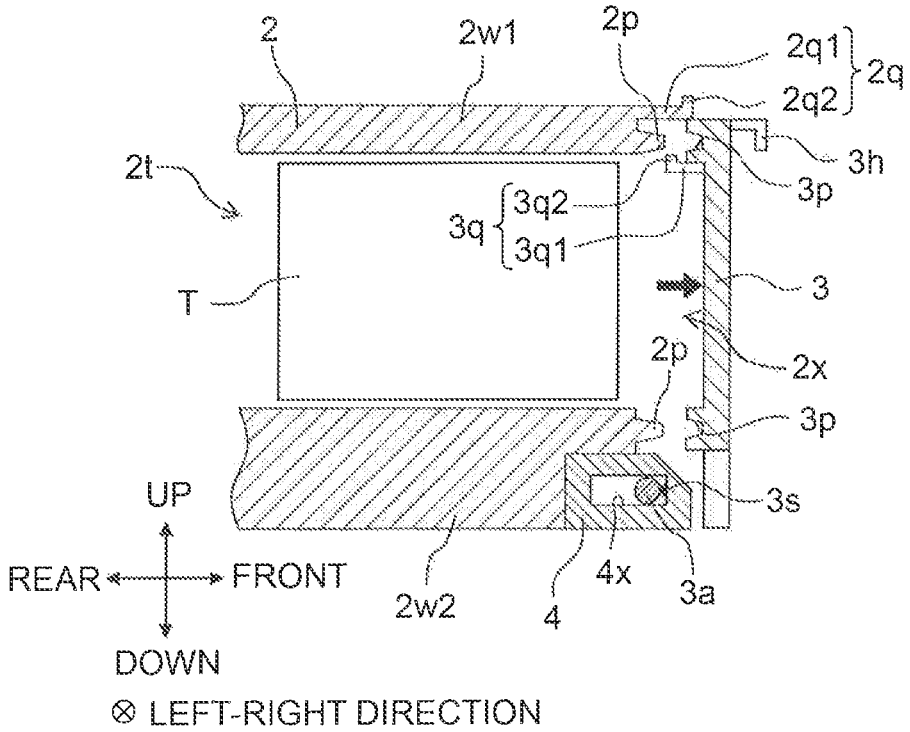
FIG. 3B is a cross-sectional view depicting a state in which the cover has moved frontward from a state of FIG. 3A to a release position.

When opening the cover 3, the user moves the cover 3 frontward while holding the handle 3*h* (see FIGS. 3A and 3B). This moves the cover 3 from an engagement position depicted in FIG. 3A to a release position depicted in FIG. 3B. The movement of the cover 3 from the engagement position to the release position is achieved by moving the pivoting shaft 3*a* frontward with the left and right ends of the pivoting shaft 3*a* being inserted into the cavities 4*x* of the guide members 4.

In the engagement position, the protrusion 2*p* is fitted into the recess 3*p* to prevent the pivoting of the cover 3. In the release position, the protrusion 2*p* is released from the recess 3*p* to allow the pivoting of the cover 3. In the release position, the protrusion 3*q* does not face the upper wall 2*w*1 in an up-down direction. The engagement position corresponds to the closed position and the release position corresponds to the opened position.

After positioning the cover 3 in the release position depicted in FIG. 3B, the user pivots the cover 3 frontward (in a direction indicated by a thick arrow in FIG. 4A) while holding the handle 3*h*. In that situation, the pivoting shaft 3*a* is kept in a fixed position (the same position as that of when the cover 3 is in the release position) without moving. Then, the user may take the tank T out of the tank storing part 2*t* with the cover 3 kept in a maximum open position (a position where an angle formed by the cover 3 and the surface of the casing 2 formed with the opening 2*x* is largest, see FIG. 4B).

When closing the cover 3, for example, after disposing the tank T in the tank storing part 2*t* with the cover 3 kept in the maximum open position, the user pivots the cover 3 from the opened position to the closed position (in a direction opposite to the thick arrow direction of FIG. 4A) while holding the handle 3*h*. In that situation, the pivoting shaft 3*a* is kept in the fixed position (the same position as that of when the cover 3 is in the release position) without moving.

After positioning the cover 3 in the release position depicted in FIG. 3B, the user moves the cover 3 rearward while holding the handle 3*h*. This moves the cover 3 from the release position depicted in FIG. 3B to the engagement position depicted in FIG. 3A. The movement of the cover 3 from the release position to the engagement position is achieved by moving the pivoting shaft 3*a* rearward with the left and right ends of the pivoting shaft 3*a* being inserted in the cavities 4*x* of the guide members 4.

As described above, according to this embodiment, engaging the protrusion 2*p* with the cover 3 in the closed position prevents the entrance of foreign matter and ink leakage through the opening 2*x*. Further, causing the guide members 4 to move the cover 3 from the engagement position to the release position (see FIGS. 3A and 3B) facilitates the pivoting of the cover 3.

In the release position, the protrusion 2*p* is released from the recess 3*p* (see FIG. 3B). This facilitates the opening and closing operations of the cover 3.

The opening 2*x* is formed in the side surface of the casing 2 (see FIG. 1). This enables the user to exchange the cartridge-type tank T easily.

Figure 4A:
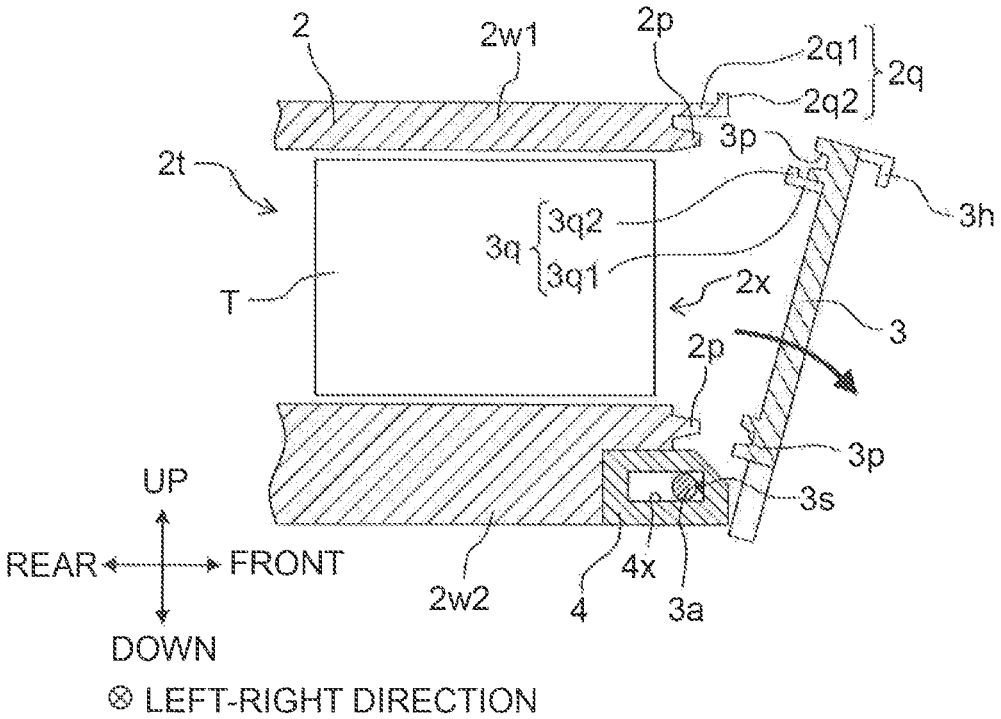
FIG. 4A is a cross-sectional view depicting a state in which the cover has pivoted frontward from a state of FIG. 3B.
Figure 4B:
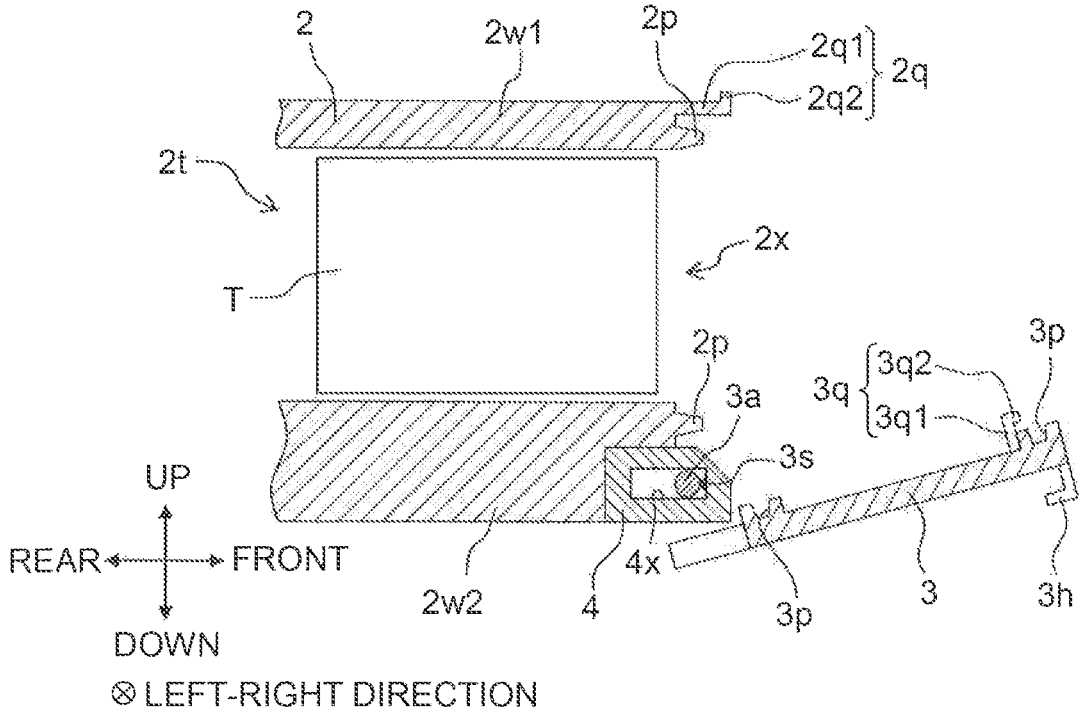
FIG. 4B is a cross-sectional view depicting a state in which the cover has pivoted further frontward from a state of FIG. 4A to a maximum open position.

The cover 3 can pivot around the pivoting shaft 3*a* extending below the opening 2*x* in a horizontal direction (see FIGS. 4A and 4B). In that configuration, the cover 3 may receive the ink leaking from the tank T, thus reducing the ink that may otherwise be scattered to the outside of the apparatus.

The protrusion 3*q* is provided in the inner surface of the cover 3. When the cover 3 is in the closed position, the protrusion 3*q* faces the upper wall 2*w*1 of the casing 2 in the up-down direction (see FIG. 3A). In that case, the protrusion 3*q* can receive foreign matter entering through the opening 2*x*. Further, the foreign matter can be dropped from the protrusion 3*q* to the outside of the apparatus during the pivoting of the cover 3.

In the release position, the protrusion 3*q* does not face the upper wall 2*w*1 in the up-down direction (see FIG. 3B). In that situation, the protrusion 3*q* does not prevent the pivoting of the cover 3.

The pivoting shaft 3*a* of the cover 3 is movably supported by the guide members 4 (see FIGS. 3A and 3B). Thus, the cover 3 can be moved with a simple configuration.

The guide members 4 guide the pivoting shaft 3*a* in the direction orthogonal to the surface of the casing 2 formed with the opening 2*x* (see FIGS. 3A and 3B). Thus, the cover 3 can be moved with a simple configuration.

The engaging part of the casing 2 to be engaged with the cover 3 is the protrusion 2*p* to be fitted into the recess 3*p* of the cover 3 (see FIGS. 3A and 3B). This reliably reduces the entrance of foreign matter and ink leakage through the opening 2*x*.

The protrusion 2*p* surrounds the whole circumference of the opening 2*x* (see FIG. 2). This reliably reduces the entrance of foreign matter and ink leakage through the opening 2*x*.

The eaves member 2*q* is provided in the vicinity of the upper portion of the opening 2*x* of the casing 2 to cover the upper edge of the cover 3 in the closed position (see FIG. 3A). This reliably reduces the entrance of foreign matter and ink leakage through the opening 2*x*.

The spring 3*s* urges the cover 3 in the opened position toward the closed position (see FIG. 3A). This reliably reduces the entrance of foreign matter and ink leakage through the opening 2*x*.

[Second Embodiment]

Figure 5:
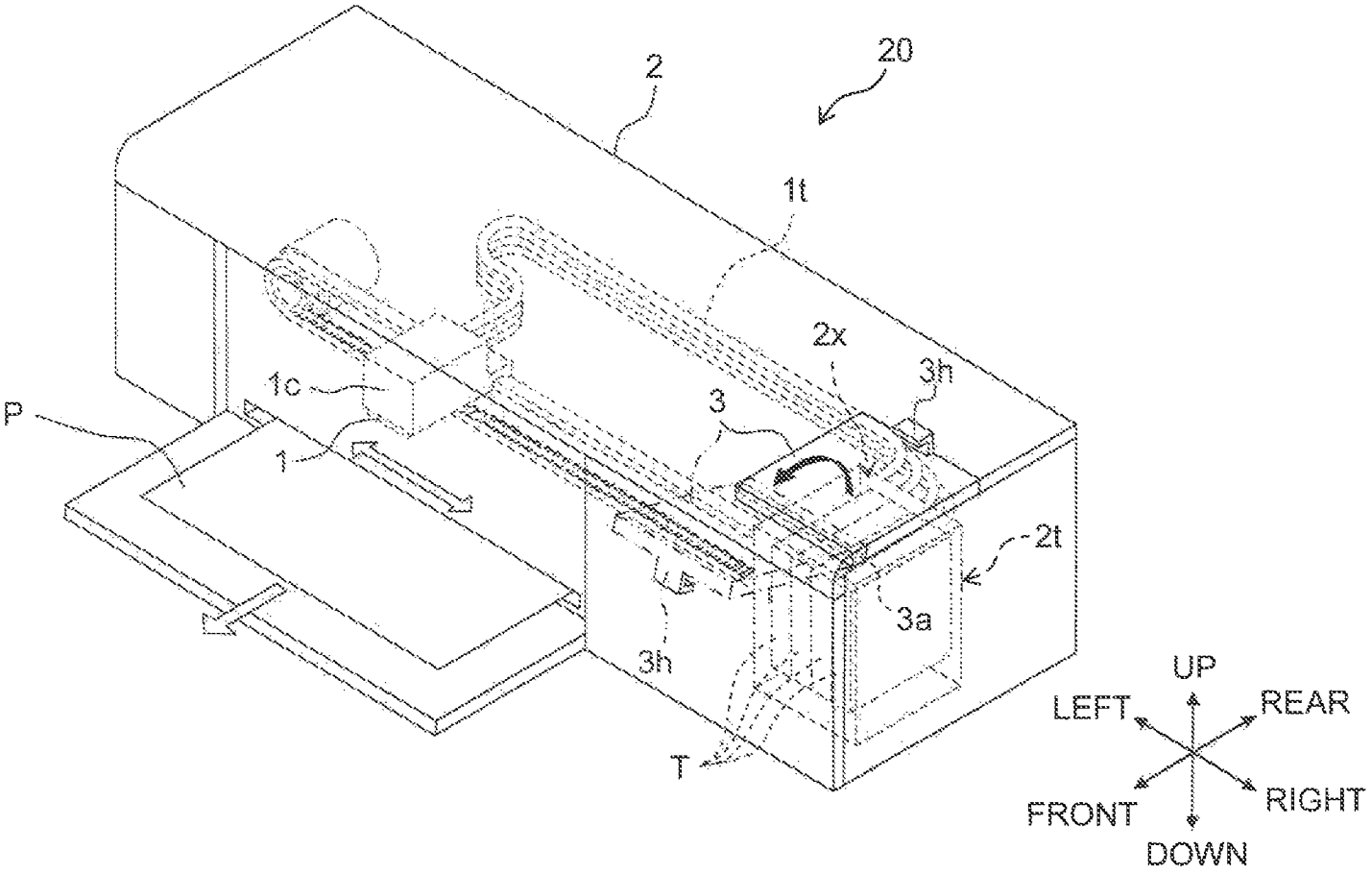
FIG. 5 is a perspective view of a printer according to a second embodiment of the present teaching.

Subsequently, referring to FIG. 5, a printer 20 according to the second embodiment of the present teaching will be explained.

The printer 20 of the second embodiment is different from the printer 10 of the first embodiment in that the opening 2*x* is formed in an upper surface of the casing 2 rather than the side surface and that respective tanks T stored in the tank storing part 2*t* are of an ink replenishment-type rather than the cartridge-type.

In the second embodiment, the opening 2*x* is formed in the upper surface of the casing 2, and thus the pivoting shaft 3*a* is movable in the up-down direction (an exemplary first direction, the direction orthogonal to the surface of the casing 2 formed with the opening 2*x*).

When opening the cover 3, the user moves the cover 3 from the engagement position to the release position by moving the cover 3 upward while holding the handle 3*h*. Then, the user pivots the cover 3 frontward with the pivoting shaft 3*a* kept in the fixed position (the same position as that of when the cover 3 is in the release position), and replenishes the ink replenish-type tank T with ink with the cover 3 kept in the maximum open position.

When closing the cover 3, for example, after replenishing the tank T with ink, the user pivots the cover 3 from the opened position to the release position while holding the handle 3*h* with the pivoting shaft 3*a* kept in the fixed position (the same position as that of when the cover 3 is in the release position). After the cover 3 reaches the release position, the user moves the cover 3 from the release position to the engagement position by moving the cover 3 downward.

Since the configuration of the printer 20 is similar to that of the printer 10 of the first embodiment, the printer 20 can obtain the similar effects to those of the printer 1. Further, since the opening 2*x* is formed in the upper surface of the casing 2, the user can replenish the ink replenish-type tank T with ink easily.

In the above description, the embodiments of the present teaching have been explained. The present teaching, however, is not limited to those embodiments. Various design changes are possible without departing from the description of the appended claims.

The opening may be formed in any surface of the casing, for example, in a lower surface of the casing. The engaging part is not limited to the protrusion fitting into the recess of the cover, and it may be a recess into which a protrusion of the cover is to be fitted. The engaging part may include both the protrusion and the recess. The engaging part may not surround the whole circumference of the opening, and it may surround a part of the opening. The movement mechanism may move the pivoting shaft in a direction different from the direction orthogonal to the surface of the casing formed with the opening (e.g., a direction parallel to the surface of the casing formed with the opening). The movement mechanism is not limited to one moving the pivoting shaft of the cover, and it may be one moving a part of the cover other than the pivoting shaft. The movement of the cover between the engagement position and the release position and the pivoting of the cover may not be manually performed by the user, and they may be performed by control of the controller. The urging member may urge any part of the cover without limited to the pivoting shaft of the cover. Or, the urging member may be omitted. The protrusion provided in the inner surface of the cover and the eaves member provided in the vicinity of the upper portion of the opening of the casing may be omitted. The present teaching may be applicable to facsimile machines, copy machines, multifunction peripherals, and the like without limited to the printers.

What is claimed is:

1. A liquid jetting apparatus, comprising:

a liquid jetting unit configured to jet liquid;

a casing including a tank storing part in which a tank containing the liquid to be supplied to the liquid jetting unit is stored, and having an opening which allows the tank storing part to communicate with an outside of the casing; and a cover pivotally attached to the casing and selectively positioned in a closed position where the opening is closed and an opened position where the opening is open, wherein the casing includes an engaging part configured to engage with the cover in the closed position to prevent the pivoting of the cover, and the liquid jetting apparatus further comprises a movement mechanism configured to move the cover relative to the casing between an engagement position where the engaging part is engaged with the cover to prevent the pivoting of the cover and a release position where the pivoting of the cover is not prevented, wherein the movement mechanism is configured to move a pivoting shaft of the cover.

2. The liquid jetting apparatus according to claim 1, wherein the engaging part is released from the cover in the release position.

3. The liquid jetting apparatus according to claim 1, wherein the opening is formed in a side surface of the casing.

4. The liquid jetting apparatus according to claim 3, wherein the cover is configured to pivot around a pivoting shaft which extends below the opening in a horizontal direction.

5. The liquid jetting apparatus according to claim 4, wherein a protrusion is provided in an inner surface of the cover, and the protrusion faces, in a vertical direction, an upper wall defining an upper edge of the opening of the casing in a state where the cover is in the closed position.

6. The liquid jetting apparatus according to claim 5, wherein the protrusion does not face the upper wall in the vertical direction in a state where the cover is in the release position.

7. The liquid jetting apparatus according to claim 1, wherein the opening is formed in an upper surface of the casing.

8. The liquid jetting apparatus according to claim 1, wherein the movement mechanism is configured to move the pivoting shaft in a direction orthogonal to a surface of the casing formed with the opening.

9. The liquid jetting apparatus according to claim 1, wherein the engaging part is at least one of a protrusion to be fitted in a recess formed in the cover and a recess to which a protrusion formed in the cover is to be fitted.

10. The liquid jetting apparatus according to claim 1, wherein the engaging part surrounds a whole circumference of the opening.

11. The liquid jetting apparatus according to claim 1, wherein an eaves member is provided in the vicinity of the opening of the casing to cover an edge of the cover in the closed position.

12. The liquid jetting apparatus according to claim 1, further comprising an urging member configured to urge the cover in the opened position toward the closed position.

* * * * *